United States Patent [19]

Godfrey

[11] Patent Number: 4,872,276

[45] Date of Patent: Oct. 10, 1989

[54] CALENDERING PROCESS FOR POLYESTER FABRIC

[75] Inventor: Thomas E. Godfrey, Moore, S.C.

[73] Assignee: Milliken Research Corporation, Spartanburg, S.C.

[21] Appl. No.: 194,674

[22] Filed: May 13, 1988

[51] Int. Cl.[4] ..... D06F 67/02; B30B 3/04

[52] U.S. Cl. ..... 38/101; 38/144; 428/225

[58] Field of Search ..... 38/144, 101; 2/272; 428/225; 100/176, 38

[56] References Cited

U.S. PATENT DOCUMENTS

| | | | |
|---|---|---|---|
| 2,828,528 | 4/1958 | Gajjar | 38/144 X |
| 3,566,781 | 3/1971 | Kunze | 100/172 |
| 4,601,937 | 7/1986 | Latussek | 2/272 |

*Primary Examiner*—Andrew M. Falik

*Attorney, Agent, or Firm*—George M. Fisher; H. William Petry

[57] ABSTRACT

A polyester-containing fabric is calendered, using unheated calender rolls and at pressures between about 1,000 p.s.i. and about 3,500 p.s.i., for the purpose of improving the drapeability characteristics of such fabric.

3 Claims, 1 Drawing Sheet

CALENDERING PROCESS FOR POLYESTER FABRIC

This invention relates to a process for treating textile fabrics to improve the drapeability of such fabrics. More specifically, this invention relates to a cold calendering process which significantly and permanently improves the suitability of woven fabrics comprised at least in part of synthetic yarns for use as a window drape. The process of this invention reduces the stiffness of the fabric and increases its ability to retain aesthetically pleasing folds extending along the length of the drape.

In the context of decorative window treatments, drapeability may be defined as the ability to arrange the drapery fabric in flowing lines or folds in accordance with a pattern or design. In a window drape intended to be suspended from the top of a window, a drape exhibiting optimum drapeability would be one having the same width and the same number of folds or pleats at the bottom as it has at the top. Resilience is a term used to describe the tendency or ability of the fabric to revert to its original shape or configuration after being folded or bent. Bending stiffness is a term used to describe the relative force necessary to bend the fabric through a given angular displacement. Bending recovery is a term used to describe the extent to which a flat fabric which has been bent through a given angle recovers its original flat configuration.

Drapes manufactured from fabrics which are blends of cotton, acetate, rayon, polyester, and various other natural and synthetic fibers offer drapeability characteristics which are generally acceptable. Drapes comprised of woven 100% filament polyester fabric have been attempted, because of the wide variety of visual and textural effects which can be achieved. Due to the extremely high resilience and crease-resisting properties of such fabric, however, the resulting drapes have offered only limited drapeability. Freely suspended full window length drapes made from 100% filament polyester yarns tend to assume a generally trapezoidal shape and have fewer or more widely spaced folds near the bottom than near the top. As a result, drapes made primarily from filament polyester fabric exhibit undesirable drapeability characteristics in many instances.

Numerous attempts nhave been made to improve the drapeability of drapery fabric made from polyester yarns by reducing the resilience and bending stiffness of such fabric. For example, softeners and lubricants have been added to the fabric in the manufacturing process. This generally improves the hand of the fabric, but does not significantly or permanently improve the drapeability of the fabric. Another manufacturing technique is known as warp stretching. By heating the polyester fabric to a pre-determined temperature and placing it under tension in the warp direction, the warp yarns may be slightly stretched, which allows the yarns in the fill direction to "relax" and offer less resistance to bending. This procedure is of some benefit in reducing the bending stiffness of the fabric in the fill direction (i.e., generally across the width of the drape), but does not substantially improve (i.e., reduce) the resilience of the fabric.

Other techniques, which involve manipulating the finished drape, include steam treating the desired folds into the fabric, which allows the polyester to relax temporarily. This technique, however, has no permanent effect on the resilience. As a result, after a relatively short time, the steamed folds become shallow and the width of the fabric increases to near its original, presteamed dimension. Other techniques for addressing the problem include placing weights in the bottom hem of the drapes to prevent flaring. This often results in nonuniform folds along the length of the drape. Placing monofilament fishing line or the like along the bottom of the drapery hem has also been attempted in an effort to form and hold folds along the bottom of the drape. This technique, however, is time consuming and adds significantly to the cost of the drape.

In accordance with the teachings of this invention, it has been found that high pressure calendering (e.g., up to about 3500 pounds per square inch), preferably at relatively cool temperatures (e.g., below about 150° F.), provides a dramatic and permanent decrease in both the resilience and bending stiffness of the polyester drapery fabric and allows drapes made from such treated fabric to exhibit exceptional drapeability characteristics.

The invention provides an economical method wherein the drapeability of polyester drapery fabric may be dramatically and permanently improved, with no degrading effect on fabric hand, and no need for additional fiber soaking, scouring, or neutralizing steps common to chemical treatments.

A special advantage of this invention is that the calender-type roll used need not be heated, thereby conserving energy costs and, by reducing the number of process variables involved, increasing the uniformity of the treated product. Because the calender roll is not heated, surface softening and re-hardening of the constituent yarns in the fabric does not occur. As a result, adverse characteristics otherwise associated with conventional, i.e., heated, calendering, such as a shiny and relatively stiff fabric surface may be avoided.

Additional advantages and benefits, as well as other features of this invention which assume substantial importance in combination with one another, will become apparent in reviewing the detailed description which follows and the accompanying drawings.

Figure 1:
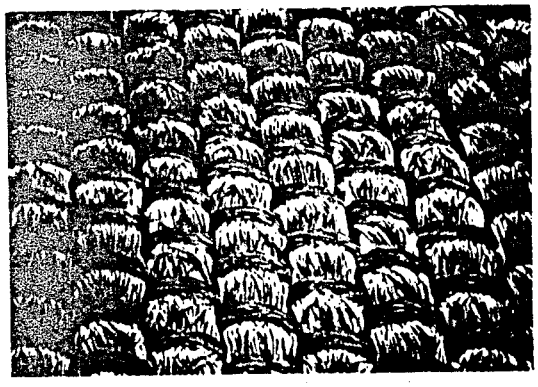
FIGS. 1 and 2 are scanning electron photomicrographs (30×, 70° tilt), as seen along the fill direction, of a 100% polyester fabric prior to treatment and following two treatments, respectively, in accordance with this invention.

The fabric to be processed in accordance with the teachings herein may be in either a dyed or undyed state, may be wet or dry, and may be comprised of 100% filament polyester, or other types of polyester yarns. The fabric may also be a blend of polyester and other synthetic or natural yarns or fibers; the process of the invention is believed to be generally effective for such fabrics as well.

In a preferred embodiment, the fabric is fed by conventional means through a pair of opposed calender rolls which extend across the entire width of the fabric web. The rolls preferably are not heated, resulting in a calender temperature corresponding to ambient or room temperature, or to the temperature of the fabric being processed. The presence of excessive heat (e.g., over about 150° F.) tends to impart objectionable stiffness and shine to the fabric surface which results in an undesirable hand and contributes to undesirable drapability characteristics. Excess calender pressure is known to have similar undesirable effects on the fabric surface. For these reasons, calender temperatures below about 150° F. (e.g., "cold" calendering), and calender pressures below about 3,500 p.s.i., are preferred. More specifically, it has been determined that "cold" calender temperatures of about 125° F. or less, when combined with calendering pressures of at least about 1,000 p.s.i., but less than about 3,500 p.s.i., result in a fabric having substantially improved resilience and bending stiffness performance with regard to use as a drape. In particular, calendering pressures of about 2,000 to about 3,100 p.s.i., and most preferably between about 2,500 p.s.i. and about 3,000 p.s.i., at temperatures below 150° F., and preferably below 125° F., and most preferably at substantially room temperature, have been found to provide 100% polyester fabrics having dramatically improved drapeability performance compared with untreated but otherwise similar fabrics, as described in the following Examples.

EXAMPLE 1

A woven drapery fabric comprised of a mix of two-ply 150/34 56T dacron and two-ply 150 polyester filament in the warp direction and eight singles spun polyester in the fill direction was treated in accordance with the above teachings, at a pressure of about 2500 p.s.i. and a temperature of about 80° F.

Ten inch by ten inch squares of the fabric were cut prior to and following the treatment, thereby forming a "control" and "treated" sample, respectively. Each sample was folded three times at the top and stapled, yielding two complete "front" folds and one complete "rear" folds. In cross-section across the folds, the fabric roughly resembled a cosine curve over 720°.

When suspended from the stapled end, the free end of the control sample flared greatly, while the free end of the treated sample flaired only moderately. To quantify the results, the distance between the center of one front fold to the center of the other front fold in each sample was measured and given the designation "A." Additionally, the distance across the full rear width of the folded panel in each sample was measured and given the designation "B." The results of the measurements are as follows:

| | "A" | "B" |
|---|---|---|
| Control Sample | 2¼" | 4" |
| Treated Sample | 1¾" | 2¼" |

The treated fabric exhibited no significant change in hand, except that the fabric was substantially less "springy" and was substantially more capable of maintaining vertical folds when suspended, as indicated above.

EXAMPLE 2

The procedures of Example 1 were followed, except that woven fabric was comprised of a two-ply 150 6856T polyester warp and the polyester fill yarns were a mix of four-ply 150 92T and 56T within a single component.

Measurements similar to those of Example 1 were followed taken with the following results:

| | "A" | "B" |
|---|---|---|
| Control Sample | 2¾" | 5" |
| Treated Sample | 2" | 3" |

As before, the treated fabric exhibited no significant change in hand, except for the improvement in drapeability indicated above.

Figure 2:
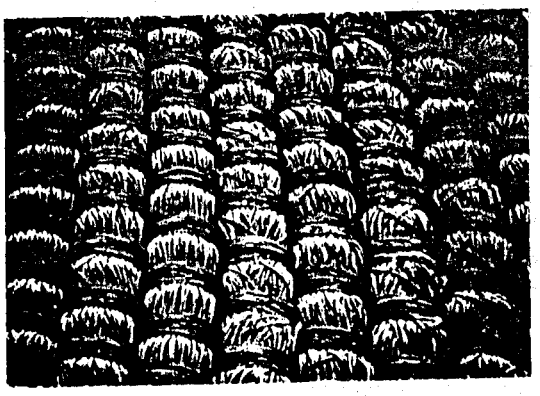
Figure 3:
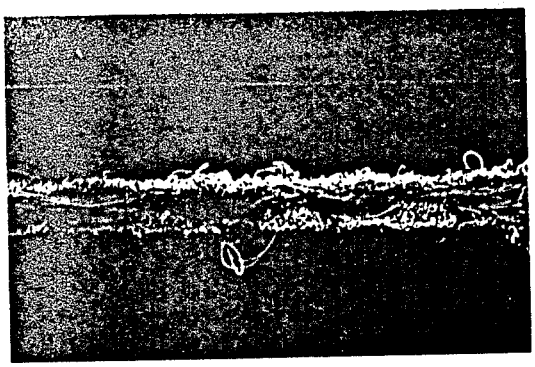
FIGS. 3 and 4 are scanning electron photomicrographs (18×) of cross sections of a 100% polyester fabric prior to treatment and following treatment, respectively, in accordance with this invention.
Figure 4:
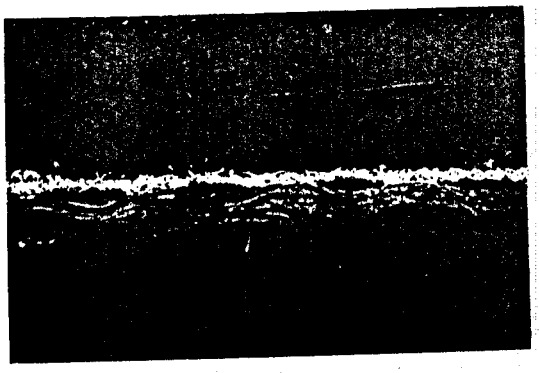
Figure 5:
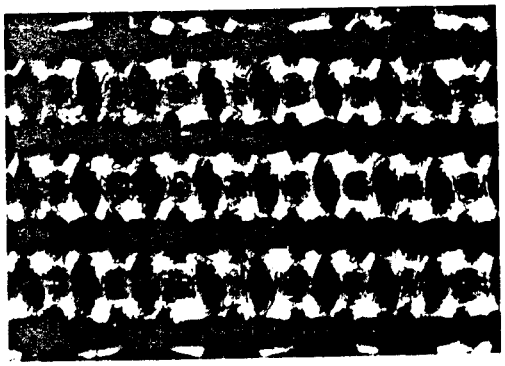
FIGS. 5 and 6 are optical photomicrographs (10×), using transmitted light, of a polyester-containing fabric prior to and following treatment, respectively, in accordance with this invention.
Figure 6:
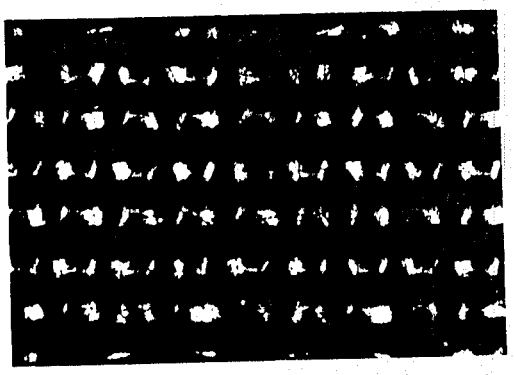

It is believed that the action of the calender rolls effectively flattens the yarns of the fabric and compresses the yarn bundles into a small volume. This is believed to be clearly visible in FIGS. 1 and 2. FIGS. 3 and 4, showing a fabric prior to and following treatment, respectively, also shows the flattening and compressing effect. It is theorized tnat this flattening and compressing creates greater friction between adjacent fibers and between adjacent yarn bundles and makes it more difficult to achieve the slippage necessary for the fabric to recover from folding and return to its original configuration. The absence of appreciable heat during the calendering process is believed to minimize the stiff hand and surface shine or sheen commonly associated with conventional calendering treatments.

I claim:

1. A method for treating a woven textile fabric comprised of polyester-containing yarns to decrease the bending recovery of said fabric, comprising passing said polyester-containing fabric between a pair of opposed calender rolls while maintaining the pressure exerted on said fabric by said rolls at a substantially uniform value, said valve being within the range of about 1,000 p.s.i. and 3,500 p.s.i., and maintaining said fabric at a temperature below about 150° F. while passing said fabric between said opposed rolls.

2. The method of claim 1 wherein said pressure value is within the range of about 2,000 p.s.i. and about 3,100 p.s.i., and wherein said fabric is maintained at a temperature below about 125° F.

3. The method of claim 1 wherein said pressure value is within the range of about 2,500 p.s.i. to about 3,000 p.s.i., and wherein said fabric is maintained at substantially room temperature.

* * * * *